US006669524B2

(12) United States Patent
Suzuki et al.

(10) Patent No.: US 6,669,524 B2
(45) Date of Patent: Dec. 30, 2003

(54) METHOD OF TREATING SURFACE OF FACE PANEL FOR IMAGE DISPLAY

(75) Inventors: Atsushi Suzuki, Osaka (JP); Masahiro Yamamura, Osaka (JP); Yasunori Miura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 177 days.

(21) Appl. No.: 09/813,202

(22) Filed: Mar. 20, 2001

(65) Prior Publication Data

US 2001/0028213 A1 Oct. 11, 2001

(30) Foreign Application Priority Data

Apr. 7, 2000 (JP) ..... 2000-106036

(51) Int. Cl.[7] ..... H01J 29/28
(52) U.S. Cl. ..... 445/58; 427/168; 348/820
(58) Field of Search ..... 445/24, 58; 427/168; 348/820, 834, 835, 819

(56) References Cited

U.S. PATENT DOCUMENTS 4,945,282 A * 7/1990 Kawamura et al. ..... 313/479
5,122,709 A * 6/1992 Kawamura et al. ..... 313/479
5,291,097 A * 3/1994 Kawamura et al. ..... 313/478
5,770,258 A * 6/1998 Takizawa et al. ..... 427/64
5,869,129 A 2/1999 Aben et al.
5,900,275 A * 5/1999 Cronin et al. ..... 427/108
6,001,486 A * 12/1999 Varaprasad et al. ..... 428/428
6,268,059 B1 * 7/2001 Cronin et al. ..... 428/432
6,323,592 B1 * 11/2001 Takahashi et al. ..... 313/479

FOREIGN PATENT DOCUMENTS

| | | | |
|---|---|---|---|
| EP | 0 517 611 | | 12/1992 |
| JP | 10-2749043 | * | 5/1998 |
| JP | 11-67083 | * | 3/1999 |

* cited by examiner

*Primary Examiner*—Kenneth J. Ramsey
(74) *Attorney, Agent, or Firm*—Merchant & Gould, P.C.

(57) ABSTRACT

In a method of treating a surface of a face panel for an image display including forming a film on the surface using coating materials, the film is formed of at least two layers including a first layer formed by a spray coating method and a second layer formed by a spin coating method to be superposed on the first layer. Thus, a face plate having antireflection/antistatic effects and providing high-resolution images can be obtained with high efficiency.

5 Claims, 5 Drawing Sheets

METHOD OF TREATING SURFACE OF FACE PANEL FOR IMAGE DISPLAY

BACKGROUND OF THE INVENTION

1. Field of the Invention

The present invention relates generally to an image display and a method of treating a surface of a face panel used for the same.

2. Related Background Art

Face panels of image displays such as cathode-ray tubes, liquid crystal displays, and plasma displays are provided with surface coatings for reducing the reflection of outside light, static electricity, or the like.

In order to reduce the reflection of outside light, for example, the following methods can be used. In one method, as shown in FIG. 10, a coating film 14 with irregularities allowing light to scatter is provided on the surface of a face panel 2 by a spray coating method in which a coating material is sprayed on the surface of a face panel. In another method, at least two layers of coating films are formed by a spin coating method in which a coating material is spread over the surface of a face panel while the face panel is rotated, and thus at least two layers of coating films 15*a* and 15*b* causing light interference are provided as shown in FIG. 11. Furthermore, in order to utilize two effects of the interference and scattering of light together, recently, the following method also is used. That is, on the two layers of coating films 15*a* and 15*b* formed by the spin coating method, a third coating film 16 with surface irregularities further is provided by the spray coating method as shown in FIG. 12.

However, the above-mentioned conventional methods have the following problems.

In the method of providing a layer with surface irregularities on an outer surface of a panel by the spray coating method to scatter outside light, a high effect of reducing reflection is provided. Recently, however, this method tends not to be preferred. The reason is that the irregularities of the film cause an image to be displayed to be blurred and thus a high-resolution image quality cannot be obtained, or the film allows outside light to be reflected diffusively and thus the whole face panel looks whitish, which results in the deterioration in image contrast.

In the method of providing two layers of interference films by the spin coating method or further providing a layer with surface irregularities by the spray coating method on the two layers formed by the spin coating method, there is a problem in that the material cost is high. This is because coating materials are used in larger amounts than those of the coating material actually applied so as to be spread uniformly by the spin coating method and surplus coating materials that have not been applied are wasted, which results in a low material utilization rate. Particularly, for the formation of two layers of films, generally, an expensive conductive material is used as a material of the first layer to provide an antistatic effect and an electromagnetic wave shielding effect. Moreover, when the utilization rate of this material is low, the material cost further increases, which has been a problem.

SUMMARY OF THE INVENTION

Therefore, it is an object of the present invention to provide a treatment method for efficiently obtaining a face panel having antireflection and antistatic effects and allowing high-resolution images to be obtained, and to provide an image display with the face panel.

In order to solve the above-mentioned problems, a method of treating a surface of a face panel for an image display according to the present invention includes forming a film on the surface using coating materials. The film is formed of at least two layers and includes a first layer formed by a spray coating method and a second layer formed by a spin coating method to be superposed on the first layer.

This allows the upper layer to have a smooth surface.

In the method of treating a surface of a face panel for an image display according to the present invention, preferably, the coating material used for forming the first layer contains no binder component.

This allows the first layer to have a smooth surface.

In the method of treating a surface of a face panel for an image display according to the present invention, preferably, the first layer has a mean surface roughness of less than 0.20 $\mu$m before the second layer is formed. In this context, the "mean surface roughness" denotes a center line average height Ra.

This allows the second layer to have a smooth surface.

Furthermore, in the method of treating a surface of a face panel for an image display according to the present invention, preferably, the first layer has brittleness before the second layer is formed.

According to this, the first layer alone tends not to coagulate in a state with surface irregularities and thus has a smooth surface. In addition, the first layer allows a coating material of an upper layer easily to soak thereinto.

In the method of treating a surface of a face panel for an image display according to the present invention, preferably, the coating material used for forming the second layer is made of a material to react irreversibly.

This allows the first and second layers to coagulate to form a coating film with high hardness and adhesiveness.

An image display of the present invention includes a face panel with a film formed on its surface using coating materials. The film is formed of at least two layers and includes a first layer formed by a spray coating method and a second layer formed by a spin coating method to be superposed on the first layer.

According to this configuration, an image display can be obtained that has a face panel providing high contrast and allows a high-resolution image quality to be obtained.

DETAILED DESCRIPTION OF THE INVENTION

An embodiment of the present invention is described as follows.

In the present embodiment, the description is directed to an example using a cathode-ray tube as an image display.

Figure 2:
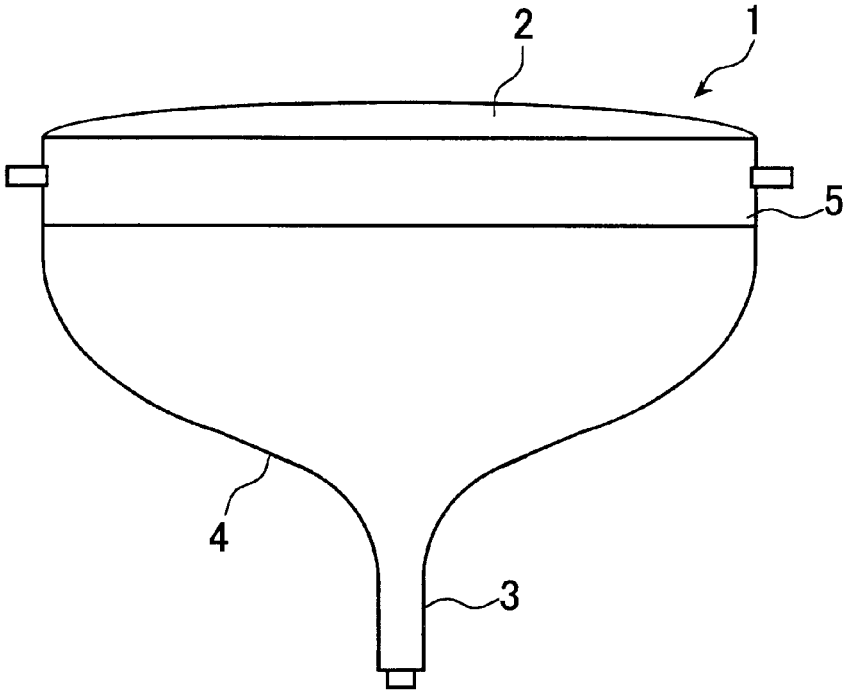
FIG. 2 is an external view of a cathode-ray tube according to the embodiment of the present invention.

FIG. 2 is an external view of a cathode-ray tube 1. The cathode-ray tube 1 includes an envelope formed of a face panel 2 with a phosphor screen formed on its inner face and a funnel 4 containing an electron gun in a neck portion 3. After evacuation, the cathode-ray tube is reinforced with a shrunk band 5 and then two layers of coating films are formed on the outer surface of the face panel 2 (a coating film process).

Next, the procedure of the film coating process is described. The face panel is polished, washed, and dried, and then is heated with a far-infrared radiation heater.

In this state, a first layer is formed by a spray coating method using a two-fluid air atomizing spray. A robot with a spray nozzle mounted on its end is operated to move the spray nozzle over the face panel and to spray a mixture of a coating material and a gas with a pressure of about 0.4 MPa. Thus, the coating material is applied.

After that, a second layer is formed on the first layer by the spin coating method. In this case, while the face panel is rotated at 70 rpm about a tube axis as a rotation center, a coating material is dropped at substantially the center of the face panel through a nozzle. Then, while the nozzle is moved toward the periphery of the face panel, the coating material is spread throughout the surface of the face panel using centrifugal force. Afterward, the face panel is rotated at 100 rpm for about one minute until the coating film is dried to some degree. Then, the face panel is rotated at 130 rpm, so that the surplus coating material is shaken off.

When the face panel is preheated with the far-infrared radiation heater before the formation of the coating film, the temperature of the outer surface of the face panel is adjusted to be 50±5° C. This allows the face panel to have an outer surface temperature of about 40° C. at the end of the application of the first layer. Thus, the suitable temperature can be obtained for the conditions for hardening the coating film as the second layer to be formed next.

Figure 1:
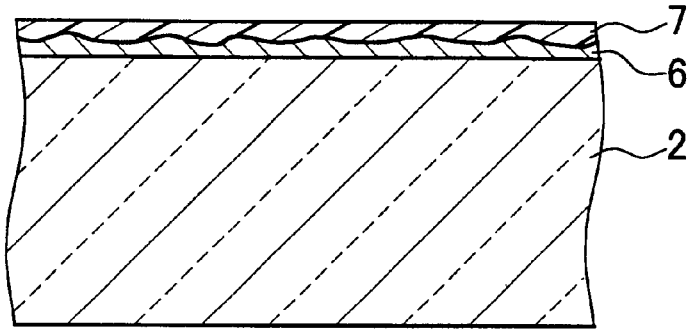
FIG. 1 is a partial sectional view of a face panel to which a surface treatment according to an embodiment of the present invention is carried out.

A coating film 6 as the first layer and a coating film 7 as the second layer as shown in FIG. 1 are formed as described above, respectively. The mean thickness of each coating film is set to be about 0.10 to 0.30 $\mu$m.

The first and second layers are formed of different coating materials. In order to obtain a film with antistatic and electromagnetic shielding properties, the coating material used for forming the first layer contains, as a main component, an organic solvent in which fine grains of an alloy of silver and palladium are dispersed to lower the resistance value and thus to obtain a conductive material. For the second layer, an alcohol solution of ethyl silicate in which $Si(OR)_4$ is dissolved in ethanol is used so that a transparent film that can be hardened easily is obtained. Thus, two types of layers with different refractive indices formed of different materials are superposed, so that a coating film can be obtained that provides the interference effect and has an antireflection property.

In this case, the coating material used for the first layer is more expensive than that used for the second layer since it is provided with the antistatic and electromagnetic shielding properties. Hence, it is preferable to use a spray coating method with a high material utilization rate for the first layer formed using such an expensive material. In this spray coating method, it also is an advantage that the device used for it has a simple configuration. On the other hand, for the second layer, the spin coating method is used that allows a smooth coating film to be formed easily. Thus, the high cost can be reduced by using an expensive material efficiently in a device with a simple configuration. Furthermore, a face panel with a smooth surface can be formed and thus a high-contrast image quality can be obtained.

In the coating film as the first layer, no binder component that easily causes coagulation of the coating film is allowed to be contained. In this context, the "binder component" denotes materials having the function of bringing grains to form a coating film into close contact with one another (allowing the grains to adhere to one another) and congealing them. Specific examples of the binder component include silica and acrylic resin. In this context, the "coagulation" denotes, for example, coagulation in a level with a pencil scratch value of 2B obtained as a result of an evaluation of a scratch by a "testing machine method" prescribed in Japanese Industrial Standard (JIS) K5400 8.4.1 with respect to a dried coating film. The effects provided by an absence of such a binder component in the first layer are described as follows.

Figure 3:
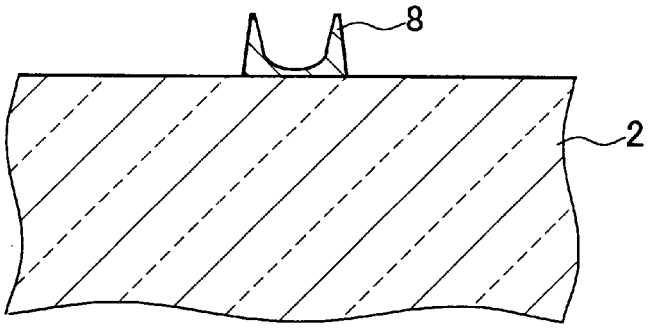
FIG. 3 is a sectional view showing a shape formed by a coating material containing a binder component sprayed to coat a face panel when the coating material hits on the face panel.
Figure 4:
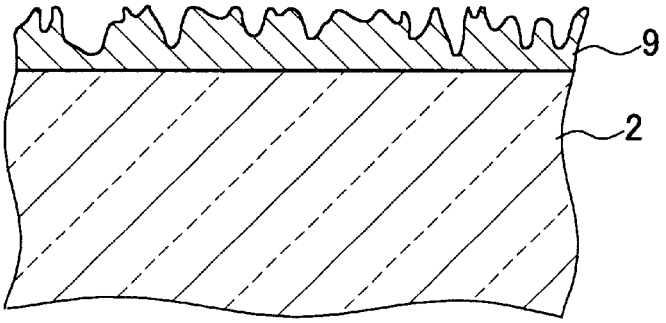
FIG. 4 is a partial sectional view showing a coating film obtained by spray coating of a coating material containing a binder component.
Figure 5:
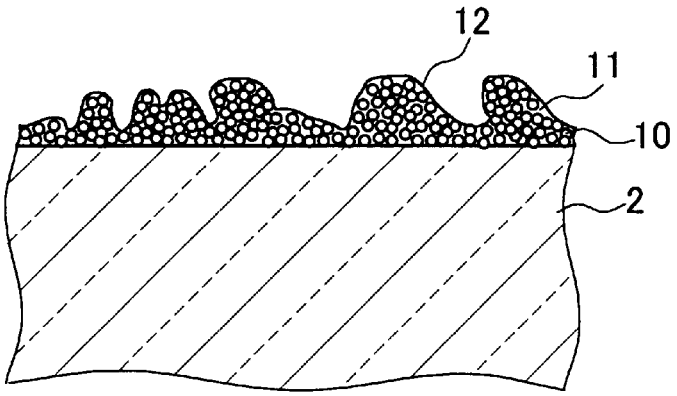
FIG. 5 is an enlarged sectional view of a model of a coating film obtained by spray coating of a coating material containing a binder component.
Figure 6:
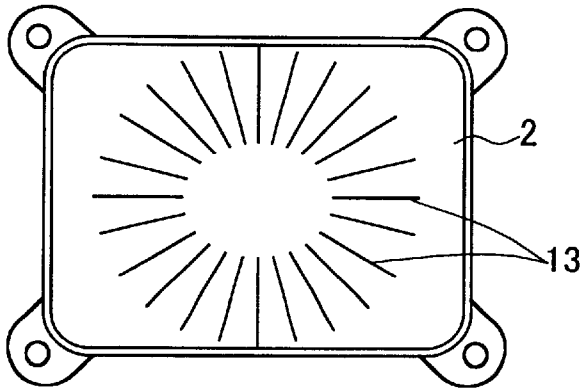
FIG. 6 is a top view of a face panel when a coating film as the second layer is formed by spin coating on a coating film as the first layer obtained by spray coating of a coating material containing a binder component.

When the coating material contains a binder component, as shown in FIG. 3, the coating material 8 sprayed on the face panel 2 tends to be hardened in a state with irregularities formed at the instant when the coating material 8 hits on the surface of the face panel 2. This is because an irreversible sol-gel reaction occurs in the binder component contained in the coating material and the coating material has high viscosity and thus tends to coagulate easily. In such a case, when the spray coating is carried out on the whole surface of the face panel 2 so that a film with a mean thickness of 0.10 to 0.30 $\mu$m can be obtained, continuous irregularities as shown in FIG. 4 are formed and hardened. Thus, a coating film 9 is obtained that has a surface in a state with random irregularities having a mean surface roughness of 0.20 to 0.50 $\mu$m. As shown in FIG. 5, an interface 12 of the coating film 9 is formed of a binder component 11 coagulated with fine grains 10 contained therein. When the second layer is formed by the spin coating method later, the coating material flows over the interface of the first layer. Consequently, when the first layer is such a coating film with surface irregularities, the second layer also is formed in a state following the surface irregularities of the first layer and thus it is not possible to obtain a smooth coating film surface. Moreover, since the coating material flows from convex portions in the first layer as a starting point, linear-like unevenness 13 tends to occur as shown in FIG. 6 viewed from the upper face of the face panel. As a result, the quality of the coating film deteriorates.

Figure 7:
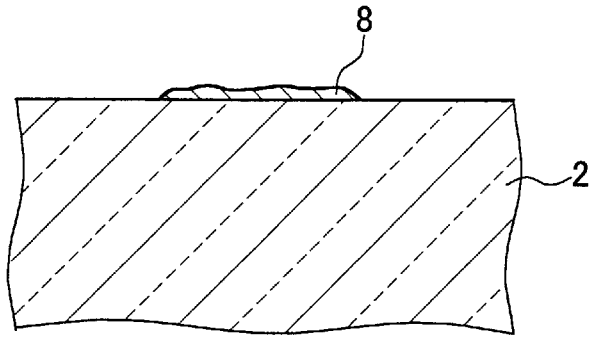
FIG. 7 is a sectional view showing a shape formed by a coating material containing no binder component sprayed to coat a face panel when the coating material hits on the face panel.
Figure 8:
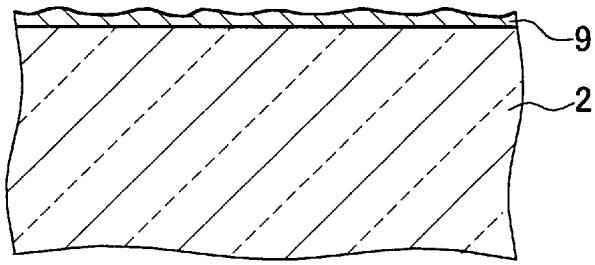
FIG. 8 is a partial sectional view showing a coating film obtained by spray coating of a coating material containing no binder component.

On the other hand, in the present embodiment, the coating material for forming the first layer is not allowed to contain any binder component in which the sol-gel reaction occurs, so that the coating material has a low viscosity and the first layer tends not to coagulate easily. Consequently, as shown in FIG. 7, the degree of irregularities is low at the instant when the coating material 8 hits on the surface of the face panel 2 and the coating material 8 does not coagulate and is leveled. As shown in FIG. 8, the coating film 9 spreads widely and has a smooth surface having a mean surface roughness of 0.01 to 0.20 $\mu$m overall. Hence, the second layer to be formed on the first layer can be formed as a coating film with a smooth surface. This improves the contrast of images seen on the face panel and the resolution of the images.

Figure 9:
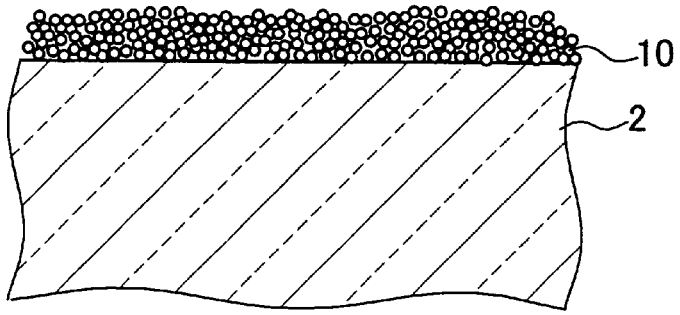
FIG. 9 is an enlarged sectional view of a model of a coating film obtained by spray coating of a coating material containing no binder component.
Figure 10:
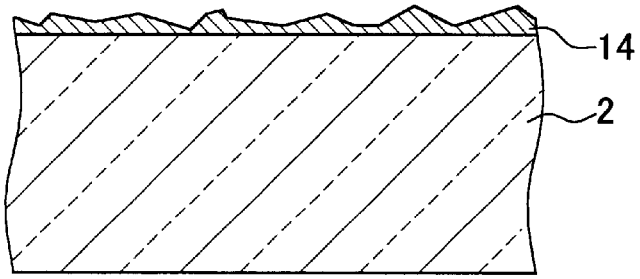
FIG. 10 (PRIOR ART)
FIG. 10 is a partial sectional view showing an example of a conventional coating film formed by a spray coating method.
Figure 11:
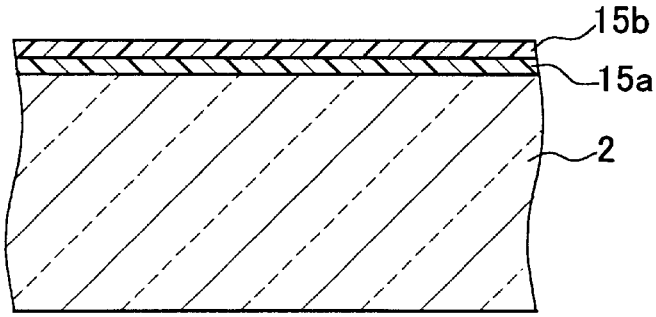
FIG. 11 (PRIOR ART)
FIG. 11 is a partial sectional view showing an example of a conventional coating film formed by a spin coating method.
Figure 12:
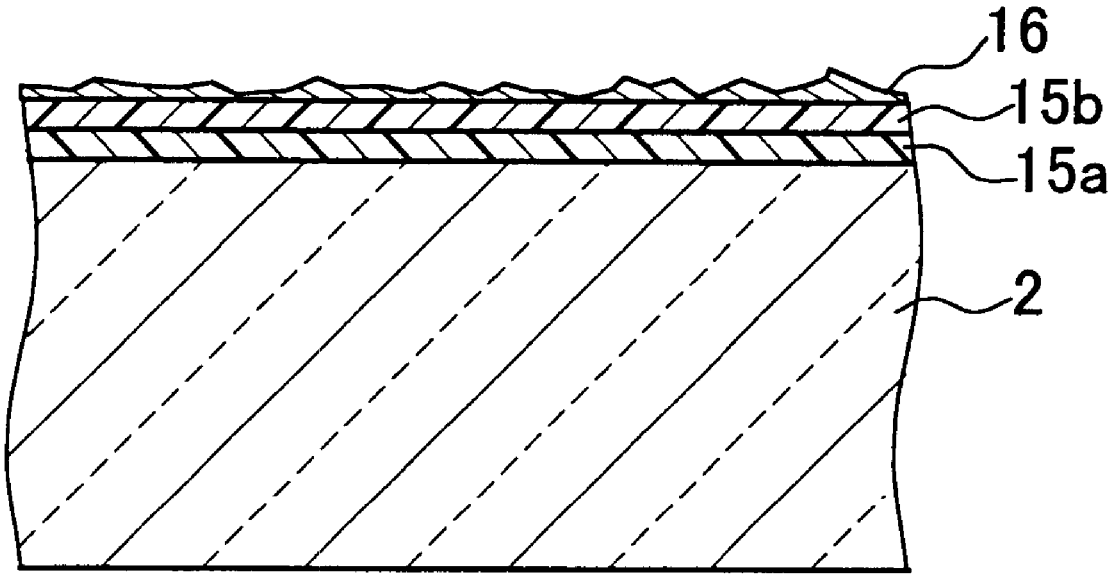
FIG. 12 (PRIOR ART)
FIG. 12 is a partial sectional view showing an example of a conventional coating film formed by a spin coating method and a spray coating method.

Since the coating material used for the first layer contains no binder component, the fine grains 10 merely are placed densely on the surface of the face panel 2 as shown in FIG. 9. Therefore, even when being dried to be hardened, the coating material does not coagulate and has a low adhesion to the face panel 2 and brittleness (for instance, in a level in which an evaluation mark is 0 as a result of an evaluation of the coating film by the "X cut tape method" prescribed in JIS K5400 8.5.3). Consequently, spaces are present among fine grains forming the coating film as the first layer. The coating material forming the second layer by the spin coating carried out later not only flows outward on the surface of the first layer by centrifugal force to form the coating film as the second layer but also penetrates among the fine grains in the first layer by a capillary phenomenon. In this case, since the coating material for forming the coating film as the second layer contains silica that coagulates easily, as a material that reacts irreversibly (i.e. reacts with substantially no reverse reaction being caused, which denotes in this case that once coagulated, a coating film does not revert to an original liquid state in an environment in which the cathode-ray tube is placed (including an environment during an operation of the cathode-ray tube)), the coating material can harden the first layer having brittleness and a low viscosity to improve the adhesiveness of the first layer to the panel. Thus, this also provides an effect in that the strength of the coating film can be increased.

In the embodiment of the present invention, two layers were formed on the surface of the face panel by the face treatment. However, the present invention is not limited to this, and another layer may be provided on or under the two layers described in this embodiment.

The mean thickness of each layer was set to be in the range of 0.1 to 0.3 $\mu$m, but is not limited to the range. The mean thickness can be changed suitably depending on the refractive index, the strength, and the material of the coating film.

In addition, besides the example using fine grains of the alloy of silver and palladium indicated in the present embodiment, indium tin oxide (ITO), antimony tin oxide (ATO), ruthenium oxide, or the like can be used as the coating material used for forming the first layer.

Paints or dyes may be mixed with the materials used for forming the respective layers and thus they may be formed as colored layers, which is not described specially in the present embodiment. This allows the contrast of the face panel further to be increased.

Furthermore, the present embodiment was directed to an example in which the coating film was formed on the face panel after the assembly of the cathode-ray tube. However, depending on the materials used for the coating film, the coating treatment may be carried out with respect to a face panel as a single member and then the cathode-ray tube may be assembled.

In the present embodiment, the face panel of a cathode-ray tube was used as an example. However, the present invention also can be applied to face panels of image displays such as liquid crystal displays, plasma displays, organic EL displays, or the like.

As described above, in the present invention, the second layer is formed by the application of a coating material that reacts irreversibly and contains a binder component on a first layer by the spin coating method. The first layer is formed by the application of the coating material made of a conductive material having a low viscosity and containing no binder component by the spray coating method. Thus, a smooth treated surface can be formed on the surface of the face panel. This allows a face panel having an antistatic property and an antireflection property and providing a high-contrast image quality to be obtained. Consequently, an image display with excellent resolution of images can be provided. In addition, a coating material made of an expensive conductive material is applied by the spray coating method, which is a simple method with a high material utilization rate, so that such surface treatment can be carried out at low cost.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of treating a surface of a face panel for an image display, comprising:

forming a film on the surface using coating materials, wherein the film comprises at least two layers including a first layer formed by a spray coating method and a second layer formed by a spin coating method to be superposed on the first layer.

2. The method of treating a surface of a face panel for an image display according to claim 1, wherein the coating material used for forming the first layer contains no binder component.

3. The method of treating a surface of a face panel for an image display according to claim 1, wherein the first layer has a mean surface roughness of less than 0.20 $\mu$m before the second layer is formed.

4. The method of treating a surface of a face panel for an image display according to claim 1, wherein the first layer has brittleness before the second layer is formed.

5. The method of treating a surface of a face panel for an image display according to claim 1, wherein the coating material used for forming the second layer is made of a material to react irreversibly.

* * * * *